US008864122B2

(12) United States Patent
Hayashi

(10) Patent No.: US 8,864,122 B2
(45) Date of Patent: Oct. 21, 2014

(54) IMAGE RECORDING APPARATUS

(75) Inventor: Akihiro Hayashi, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 63 days.

(21) Appl. No.: 13/616,647

(22) Filed: Sep. 14, 2012

(65) Prior Publication Data

US 2013/0134646 A1 May 30, 2013

(30) Foreign Application Priority Data

Nov. 25, 2011 (JP) ..... 2011-257680

(51) Int. Cl.
*B65H 5/00* (2006.01)

(52) U.S. Cl.
USPC ..... 271/2; 271/264; 271/265.01; 271/270

(58) Field of Classification Search
USPC ..... 270/2, 264, 265.01, 270
See application file for complete search history.

(56) References Cited

U.S. PATENT DOCUMENTS 5,080,509 A * 1/1992 Stone ..... 400/23
5,681,036 A * 10/1997 Wakahara et al. ..... 271/10.12
6,042,099 A * 3/2000 Takagishi ..... 271/2
6,624,902 B2 9/2003 Yoshikawa
7,099,032 B2 8/2006 Yoshikawa
7,775,518 B2 * 8/2010 Kondo ..... 271/227
8,368,930 B2 * 2/2013 Matsuura et al. ..... 358/1.15
2002/0063875 A1 5/2002 Yoshikawa
2004/0212649 A1 * 10/2004 Ouchi ..... 347/16
2004/0223170 A1 11/2004 Yoshikawa
2007/0127090 A1 * 6/2007 Nonaka ..... 358/498

FOREIGN PATENT DOCUMENTS

JP 05092841 A * 4/1993
JP 05178469 A * 7/1993
JP H11-119953 A 4/1999
JP 2005-056001 A 3/2005

* cited by examiner

*Primary Examiner* — Ernesto Suarez
(74) *Attorney, Agent, or Firm* — Banner & Witcoff, Ltd.

(57) ABSTRACT

An image recording apparatus includes: a sheet supplier configured to supply a recording medium; a first conveyor configured to convey the recording medium supplied from the sheet supplier in a conveying direction; a recording portion configured to record an image on the recording medium conveyed by the first conveyor; and a controller configured to detect an orientation of the recording medium with respect to the conveying direction while the recording medium is conveyed and change a conveying speed of the recording medium conveyed by the first conveyor depending on the detected orientation of the recording medium.

7 Claims, 6 Drawing Sheets

IMAGE RECORDING APPARATUS

CROSS REFERENCE TO RELATED APPLICATION

The present application claims priority from Japanese Patent Application No. 2011-257680, which was filed on Nov. 25, 2011, the disclosure of which is herein incorporated by reference to its entirety.

BACKGROUND OF THE INVENTION

1. Field of the Invention

The present invention relates to an image recording apparatus which records an image on a recording medium.

2. Discussion of Related Art

An image recording apparatus usually includes a conveyor for conveying a recording medium and an image is recorded on a recording medium conveyed by the conveyor. In the recording medium conveyed by the conveyor, a probability of occurrence of a paper jam differs depending on an orientation of the recording medium during conveying. Specifically, it is known that, in a case where an envelope having a flap portion is conveyed in a state in which the flap portion is a downstream end portion of the envelope in a conveying direction, the probability of occurrence of the paper jam is greater than that in a case where the envelope is conveyed in a state in which the flap portion is an upstream end portion of the envelope in the conveying direction. Therefore, a conventional printer is constructed such that, while printing on an envelope, the envelope is conveyed in a state in which a flap portion is an upstream end portion of the envelope in the conveying direction.

SUMMARY OF THE INVENTION

In the conventional printer, the occurrence of the paper jam can be restrained because the envelope is conveyed in the state in which the flap portion is the upstream end portion of the envelope in the conveying direction of the envelope. However, a user needs to set the envelope on a tray in such a way that the envelope is conveyed in the state in which the flap portion is the upstream end portion of the envelope in the conveying direction of the envelope, leading to inconvenience for the user. On the other hand, in a case where the envelope is conveyed in a state in which the flap portion is the downstream end portion of the envelope in the conveying direction of the envelope, it is possible that the paper jam occurs.

Further, the probability of occurrence of the paper jam in some recording sheets other than the envelope differs depending on an orientation of the recording sheet while the recording sheet is conveyed. Explained in detail, each recording sheet has a direction of paper fiber. In a case where the recording sheet is conveyed in such a way that the direction of paper fiber coincides with the conveying direction, the paper jam hardly occurs because the recording sheet is conveyed in such a way that the direction of paper fiber of the recording sheet coincides with the conveying direction. On the other hand, in a case where the recording sheet is conveyed in such a way that the direction of paper fiber is different from the conveying direction, the paper jam easily occurs.

It is therefore an object of the present invention to provide an image recording apparatus to restrain the paper jam and record an image on a recording sheet, even if the recording sheet is set in any orientation.

In order to achieve the above-mentioned object, according to the present invention, there is provided an image recording apparatus comprising: a sheet supplier configured to supply a recording medium; a first conveyor configured to convey the recording medium supplied from the sheet supplier in a conveying direction; a recording portion configured to record an image on the recording medium conveyed by the first conveyor; and a controller configured to detect an orientation of the recording medium with respect to the conveying direction while the recording medium is conveyed and change a conveying speed of the recording medium conveyed by the first conveyor depending on the detected orientation of the recording medium.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENT

There will be described in detail an embodiment and a modified embodiment of the invention with reference to the drawings.

[Structure of MFP 10]

Figure 1:
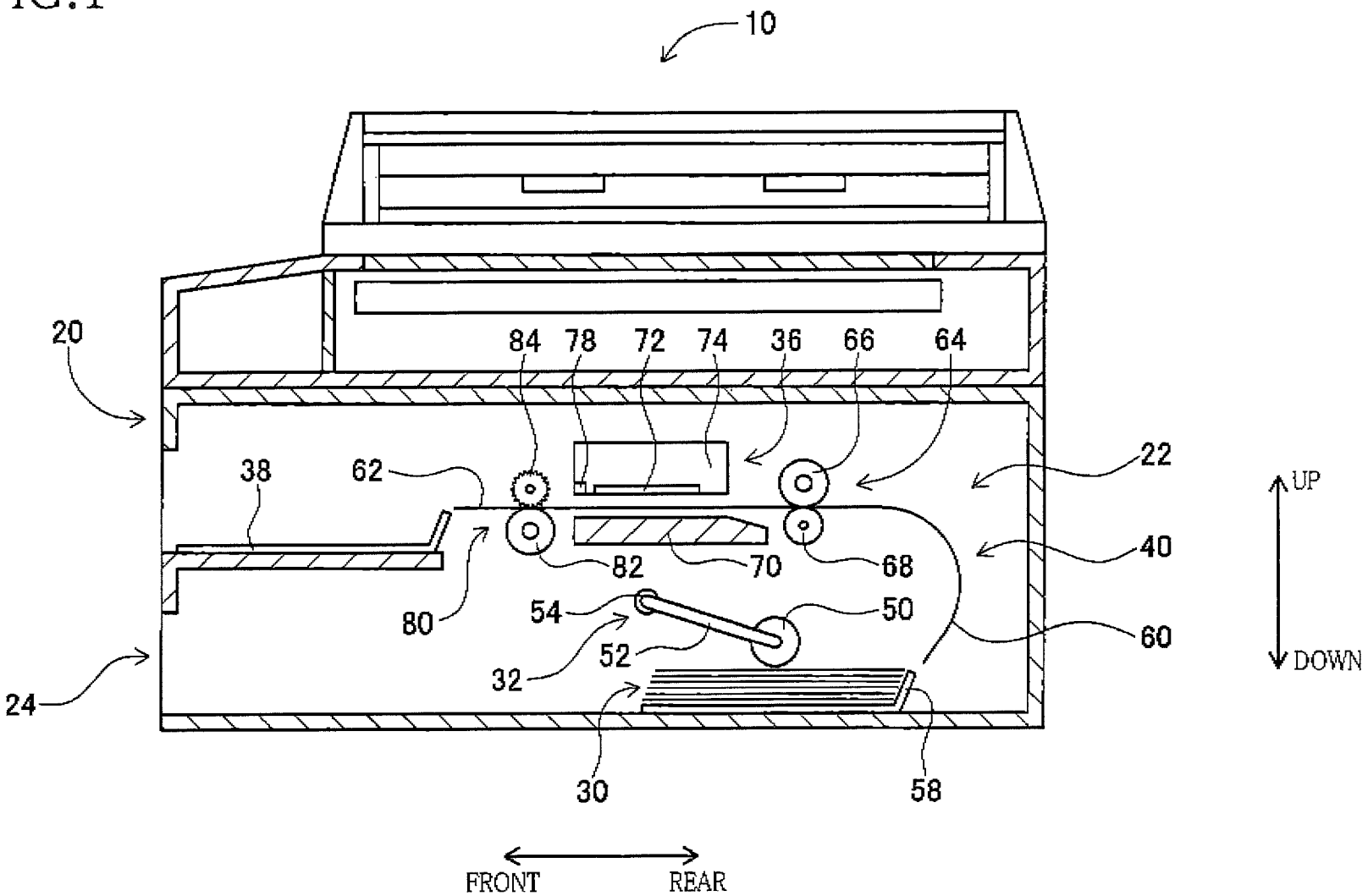
FIG. 1 is a cross-sectional view schematically showing a structure of a Multifunction Peripheral (MFP) as one embodiment of the present invention.

There will be described a Multi Function Peripheral (MFP) 10 as one embodiment of the present invention with reference to FIGS. 1 and 2. The MFP 10 has various functions including a facsimile machine function, a printer function, a scanner function, a copier function, and so forth. The MFP 10 includes a printer portion 22 inside of a casing 20, and the printer portion 22 performing the printer function is an example of an image recording apparatus to which the present invention is applied. In other words, functioning portions which respectively perform the facsimile machine function, the scanner function, the copier function and so on are not essential to realize the present invention, so that descriptions about those functioning portions will be omitted. In the present embodiment, a left side, a right side, a front side, a rear side (a backside), an upper side and a lower side in FIG. 1 respectively indicate a front side, a rear side (a backside), a right side, a left side, an upper side and a lower side in the MFP 10.

There is formed an opening 24 in a front side wall of the casing 20 of the MFP 10, and a sheet-supply tray 30 is attachable to and detachable from the opening 24 in a front-rear direction. The sheet-supply tray 30 can accommodate various kinds of recording sheets (an example of a recording medium) and supplies the recording sheets to the printer portion 22 in a state in which the sheet-supply tray 30 is inserted into the casing 20. The recording sheets include regular papers, inkjet papers, envelopes, postcards, and so forth.

The printer portion 22 includes, in addition to the sheet-supply tray 30, a sheet supplier 32 (an example of a sheet supplier) which supplies the recording sheet backward from the sheet-supply tray 30, an inkjet-type recording portion 36 (an example of a recording portion) which records an image on the recording sheet supplied by the sheet supplier 32, a sheet-discharge tray 38 which accommodates the recording sheet on which an image has been recorded. In the printer portion 22, there is formed a conveying path 40 through which, the recording sheet is conveyed from the sheet-supply tray 30 to the sheet-discharge tray 38 via the recording portion 36.

The sheet supplier 32 is for supplying the recording sheets and so on that are placed in the sheet-supply tray 30 to the conveying path 40. The sheet supplier 32 includes a sheet-supply roller 50 and a sheet-supply arm 52. The sheet-supply arm 52 is disposed above the sheet-supply tray 30 and is rotatable (pivotable) about a shaft 54 as a rotary (pivot) shaft. An end portion of the sheet-supply arm 52 supports the sheet-supply roller 50 so as to be rotatable. The sheet-supply roller 50 is held in contact with the recording sheet placed in the sheet-supply tray 30.

The sheet-supply roller 50 is rotated by transmission of a drive force of a conveyor motor 56 (shown in FIG. 2) via a drive transmission mechanism (not shown). When the sheet-supply roller 50 is rotated in a state in which the sheet-supply roller 50 is held in contact with the recording sheet, an uppermost one of the recording sheets is fed backward. There is formed an inclined separating plate 58 on a rear end of the sheet-supply tray 30, and the recording sheet is guided to the conveying path 40 by the inclined separating plate 58.

The conveying path 40 is defined by (1) a curved path 60 which extends in a curved way from a vicinity of an upper end of the inclined separating plate 58 to a rear side of the recording portion 36 and (2) a straight path 62 which extends in a straight way from the rear side of the recording portion 36 to the sheet-discharge tray 38. The recording sheet is turned (makes a U-turn) from a lower side in the casing 20 to an upper side therein through the curved path 60 and conveyed to an upstream side of the recording portion 36 in a conveying direction. On the rear side of the recording portion 36, there is disposed a first conveyor 64 (an example of a first conveyor). The first conveyor 64 is configured to convey the recording sheet supplied by the sheet supplier 32 in the conveying direction. In the present embodiment, the conveying direction is a direction in which the recording sheet is moved by the first conveyor 64 while the recording portion 36 records an image on the recording sheet, and, in FIG. 1, is a direction in which the recording sheet is moved from a rear portion of the MFP 10 to a front portion thereof (a direction from the right side to the left side in FIG. 1), and the upstream side of the recording portion 36 in the conveying direction is located at a rear side of the recording portion 36.

The first conveyor 64 includes a first conveyor roller 66 and a pinch roller 68. The pinch roller 68 is slidable in a direction in which the pinch roller 68 moves toward and away from the first conveyor roller 66, and is held in pressure contact with the first conveyor roller 66 by a coil, spring (not shown). The recording sheet conveyed through the curved path 60 is inserted between the first conveyor roller 66 and the pinch roller 68. The first conveyor roller 66 is rotated by a drive of the conveyor motor 56 (shown in FIG. 2) and cooperates with the pinch roller 68 to convey the recording sheet to the recording portion 36.

The recording sheet conveyed by the first conveyor 64 is supported by a platen 70 that is located at a front side of the first conveyor 64. The recording portion 36 is located above the platen 70 and the recording sheet is conveyed between the platen 70 and the recording portion 36.

Figure 2:
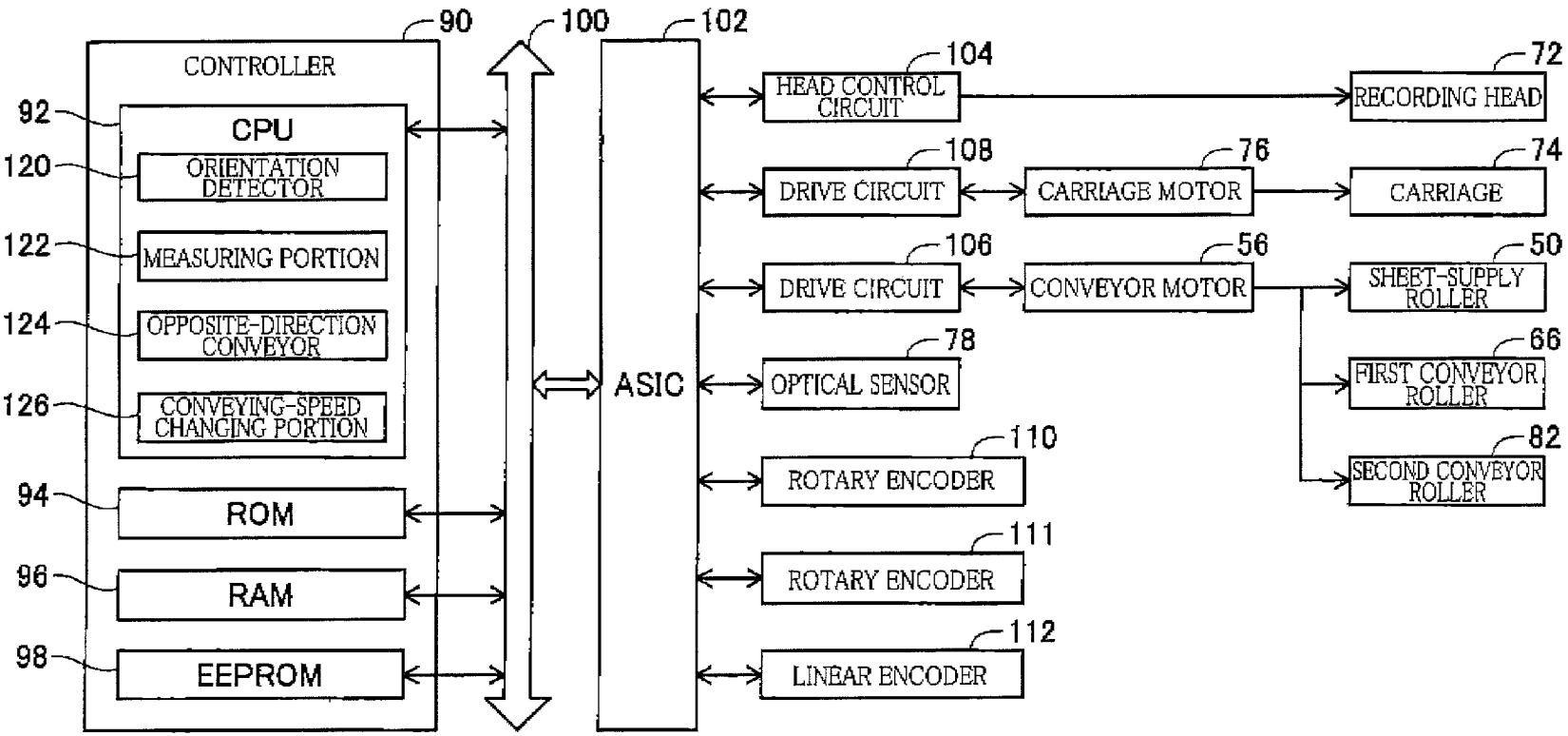
FIG. 2 is a block diagram schematically showing a structure of a controller of the MFP.

The recording portion 36 includes a carriage 74 which carries a recording head 72 and reciprocates in a main scanning direction by a drive of a carriage motor 76 (shown in FIG. 2). In the present embodiment, the main scanning direction is a direction perpendicular to the conveying direction of the recording sheet. To the recording head 72, colors of inks including cyan (C), magenta (M), yellow (Y), and black (K) are supplied from corresponding ink cartridges (not shown). On a lower surface of the recording head 72, there are disposed a plurality of nozzles (not shown) corresponding to the respective colors of inks, and the respective colors of inks are ejected as tiny droplets of ink from the nozzles. An image is thus recorded on the recording sheet supported on the platen 70. Instead of the inkjet-type, the recording portion 36 may be applicable to various recording types such as an electrophotographic-type.

On a front side of a lower surface of the carriage 74, an optical sensor 78 (an example of a detector) is disposed. The optical sensor 78 is for determining whether the recording sheet exists below the optical sensor 78 and is used in a case of measuring a width of the recording sheet, i.e., a length of the recording sheet in a direction perpendicular to the conveying direction.

Further, there is disposed a second conveyor 80 (an example of a second conveyor) on a front side of the recording portion 36 and the platen 70. The second conveyor 80 includes a second conveyor roller 82 and a spur roller 84. The spur roller 84 is slidable in a direction in which the spur roller 84 moves toward and away from the second conveyor roller 82, and is held in pressure contact with the second conveyor roller 82 by a coil spring (not shown). The second conveyor roller 80 is rotated by a drive of the conveyor motor 56 (shown in FIG. 2) and cooperates with the spur roller 84 to convey the recording sheet on which an image has been recorded to a front side. The recording sheet on which the image has been recorded is thus discharged onto the sheet-discharge tray 38 located on the front side of the second conveyor 80.

The printer portion 22 further includes a controller 90 (an example of a controller) shown in FIG. 2. The controller 90 includes a CPU 92, a ROM 94, a RAM 96 and an EEPROM 98 and is connected to an ASIC (Application Specific Integrated Circuit) 102 via a bus 100.

The ROM 94 stores programs for the CPU 92 to control various operations of the MFP 10. The RAM 96 temporarily stores various data that are used when the programs are executed. The EEPROM 98 stores settings and so forth that should be kept stored after a power turns off.

To the ASIC 102, a head control circuit 104, a drive circuit 106, a drive circuit 108, rotary encoders 110, 111, a linear encoder 112 and the optical sensor 78 are connected.

The head control circuit 104 controls a drive of the recording head 72 based on print data of the CMYK type inputted from the ASIC 102. The drive circuit 106 drives the conveyor motor 56 based on a signal and so on inputted from the ASIC 102, and a drive force of the conveyor motor 56 is transmitted to the sheet-supply roller 50, the first conveyor roller 66 and the second conveyor roller 80. The drive circuit 108 drives the carriage motor 76 based on a signal and so on inputted from the ASIC 102, and the carriage reciprocates in the main scanning direction by the drive of the carriage motor 76.

The rotary encoder 110 measures a number of rotation of the first conveyor roller 66 and detects a conveying amount of the recording sheet, and the rotary encoder 111 measures a number of rotation of the second conveyor roller 82 and detects a conveying amount of the recording sheet. The controller 90 controls an operation of the conveyor motor 56 based on the detection results by the rotary encoders 110, 111. The linear encoder 112 detects a movement amount of the carriage 74 reciprocating in the main scanning direction. The controller 90 controls an operation of the carriage motor 76 based on the detection result by the linear encoder 112.

Further, the optical sensor 78 and the linear encoder 112 measure the width of the recording sheet, i.e., the length of the recording sheet in the direction perpendicular to the conveying direction. More specifically, in such a way that the linear encoder 112 detects a range in which the optical sensor 78 detects an existence of the recording sheet in the direction perpendicular to the conveying direction, opposite ends of the recording sheet in the main scanning direction are detected, and a distance between the opposite ends of the recording sheet in the main scanning direction, i.e., the width of the recording sheet is measured by the linear encoder 112.

[Image Recording by Printer Portion 22]

The printer portion 22 having the above-described structure records an image on the recording sheet. The image recording on the recording sheet is publicly known, so that it will be simply described as follows. First, the recording sheet is supplied to the curved path 60 of the conveying path 40 by the sheet supplier 32. The recording sheet conveyed through the curved path 60 is conveyed between the recording portion 36 and the platen 70 by the first conveyor 64. When the optical sensor 78 detects conveying of the recording sheet, the operation of the recording portion 36 is controlled such that an upper portion of print data (an upper portion of print data which corresponds to print data of an envelope positioned in such a manner that a flap portion is located at an upper portion of the envelope) is recorded on a downstream end portion of the recording sheet in the conveying direction. Then, the recording sheet on which an image has been recorded is conveyed by the second conveyor 80 to be discharged onto the sheet-discharge tray 38.

Because operations of the sheet supplier 32, the first conveyor 64 and so on are thus controlled, an image is recorded on the recording sheet. However, regarding a recording of a letter such as an address on an envelope, i.e., a printing, a special printing control is operated depending on an up and down orientation of the envelope. In the special control, a conveying speed of the envelope and an orientation of print data are changed depending on the orientation of the envelope conveyed. The control will be described in detail below.

The envelope has a gluing portion called a flap portion and the flap portion is folded so as to function as a cover which covers an opening of the envelope. Hereinafter, a print control in a case where the envelope is conveyed in a state in which an upstream end portion of the envelope in the conveying direction is the flap portion will be described. In the case where the envelope is conveyed in the state in which the upstream end portion of the envelope in the conveying direction is the flap portion, the opening of the envelope faces to an upstream side in the conveying direction, so that there is little possibility that the envelope is jammed in the conveying path 40. Therefore, in the case where the envelope is conveyed in the state in which the upstream end portion of the envelope in the conveying direction is the flap portion, the envelope is conveyed by the first conveyor 64 at a preset speed, more specifically, a speed at which the recording sheet such as a regular paper and so forth except the envelope is conveyed. However, in the case where the envelope is conveyed in the above-mentioned manner, a printing starts from an end portion opposite to the flap portion, so that the operation of the recording portion 36 is controlled such that a lower portion of print data (a lower portion of print data which corresponds to print data of an envelope positioned in such a manner that a flap portion is located at an upper portion of the envelope) is printed on the end portion opposite to the flap portion. In other words, the printing of the address and so on is performed on the envelope based on print data that are rotated around by 180 degrees. An orientation of the envelope in which the envelope is conveyed in a state in which the upstream end portion of the envelope in the conveying direction is the flap portion is an example of a predetermined orientation in the present invention.

On the other hand, in a case where the envelope is conveyed in a state in which a downstream end portion of the envelope in the conveying direction is the flap portion, because the opening of the envelope faces to a downstream side in the conveying direction, it is possible that the opening of the envelope is caught in the conveying path 40 and a jamming occurs. Especially, after the downstream end portion of the envelope, i.e., the flap portion passes the first conveyor 64, the printing is then performed on the envelope, and until the flap portion is nipped by the second conveyor 80, the flap portion is not nipped by anything. Therefore, in a case where the envelope is conveyed at a higher speed after the flap portion has passed the first conveyor 64, it is possible that air intrudes into an inside of the envelope through the opening of the envelope. In this case, there is a possibility that the flap portion is separated from the platen 70 and is not appropriately nipped by the second conveyor 80. Accordingly, in the case where the envelope is conveyed in the state in which the downstream end portion of the envelope in the conveying direction is the flap portion, the first conveyor 64 conveys the envelope at a speed slower (lower) than the preset speed. Since the envelope is conveyed at such a slower speed, the jamming can be restrained.

Conveying of the envelope at the slower speed is performed until the envelope is conveyed to the second conveyor 80. This is because, when the envelope is nipped by the second conveyor roller 82 and the spur roller 84 of the second conveyor 80 located in the vicinity of a most downstream end portion of the conveying path 40 in the conveying direction, a possibility that the envelope is caught in the conveying path 40 is reduced. Since the envelope is thus conveyed at the slower speed only in a required area, a printing time can be shortened.

The orientation of the envelope being conveyed is determined based on the width of the envelope measured by the optical sensor 78 and the linear encoder 112. More specifically, the envelope is conveyed to the downstream side in the conveying direction, and, at a position where the downstream end portion of the envelope in the conveying direction is detected by the optical sensor 78, a width W1 of the envelope is first measured by the optical sensor 78 and the linear encoder 112. The envelope is then conveyed to the downstream side in the conveying direction from the above position by a specific amount L, and, at a position where the envelope is conveyed by the specific amount L, a width W2 of the envelope is measured by the optical sensor 78 and the linear encoder 112. The width W1 as a first measured value and the width W2 as a second measured value are compared with each other. In a case where the width W1 and the width W2 are identical with each other, the orientation of the envelope while conveying is determined as an orientation in which the envelope is conveyed in the state in which the upstream end portion of the envelope in the conveying direction is the flap portion. On the other hand, in a case where the width W1 is smaller than the width W2, the orientation of the envelope while the envelope is conveyed is determined as an orientation in which the envelope is conveyed in the state in which the downstream end portion of the envelope in the conveying direction is the flap portion. Thus, the orientation of the envelope while the envelope is conveyed can be appropriately determined. The specific amount L can be any amount as long as the specific amount L is smaller than a length of the envelope in the conveying direction (a length of a portion of the envelope except the flap portion in the conveying direction). In the present embodiment, for example, in a case of an envelope whose size is 240 mm×332 mm, the specific amount L is 50 mm, and, in a case of an envelope whose size is 120 mm×235 mm, the specific amount L is 20 mm.

When the orientation of the envelope is determined, as a result of conveying of the envelope to the downstream side by the specific amount L as mentioned before, there is a case where a printing area of the envelope has passed the nozzles of the recording head 72. In other words, there is a case where a part of the envelope on which an address should be printed has passed a printable area that can be printed by the recording head 72. In this case, the envelope is conveyed in an opposite conveying direction to the upstream side in the conveying direction. An opposite conveying amount in the opposite conveying direction is the same as the specific amount L.

Further, as a result of conveying of the envelope to the downstream side by the specific amount L when the orientation of the envelope is determined, there is a case where the envelope is discharged from the first conveyor 64. In this case, the envelope is conveyed in the opposite conveying direction, but it is possible that, while the envelope is conveyed in the opposite conveying direction, the jamming occurs in the first conveyor 64. Therefore, when the envelope is conveyed in the opposite conveying direction, the conveying speed is also changed depending on the orientation of the envelope in the opposite conveying direction. More specifically, in a case where the envelope is conveyed in the opposite conveying direction in a state in which a downstream end portion of the envelope in the opposite conveying direction is the flap portion of the envelope, i.e., in a case where the envelope is conveyed in the opposite conveying direction such that the flap portion of the envelope is positioned at the downstream end portion of the envelope in the opposite conveying direction, the second conveyor 80 conveys the envelope at a speed slower (lower) than the preset speed (described before) in the opposite conveying direction. Accordingly, occurrence of the jamming can be also restrained while conveying of the envelope in the opposite conveying direction.

In a case where the conveying speed of the envelope is changed, decreasing in an energizing amount (a current-carrying amount) to the conveyor motor 56 which drives the first conveyor roller 66 of the first conveyor 64 or the second conveyor roller 82 of the second conveyor 80 makes the conveying speed of the envelope slower. Instead of adjusting of the energizing amount to a motor, other various methods for changing in the conveying speed may be adopted. More specifically, a mechanism in which a gear ratio is changeable may be adopted as a mechanism for transmitting of the drive force of the conveyor motor 56 to the first conveyor roller 66 or the second conveyor roller 82, and the conveying speed of the envelope can be changed by changing in the gear ratio.

Furthermore, in a case where the envelope is conveyed in the conveying direction or in the opposite conveying direction in the state in which the downstream end portion of the envelope in the conveying direction or in the opposite conveying direction is the flap portion, the conveying speed of the envelope in the conveying direction or in the opposite conveying direction is made slower, as the width of the envelope, the length of the envelope in the direction perpendicular to the conveying direction or the opposite conveying direction, increases. In other words, when the envelope is conveyed in the conveying direction or in the opposite conveying direction in the state in which the downstream end portion of the envelope in the conveying direction or in the opposite conveying direction, the envelope having a greater width is conveyed at a slower speed in the conveying direction or in the opposite conveying direction, compared to the envelope whose width is small. Therefore, the jamming can be restrained with more certainty.

[Control Program]

Figure 3:
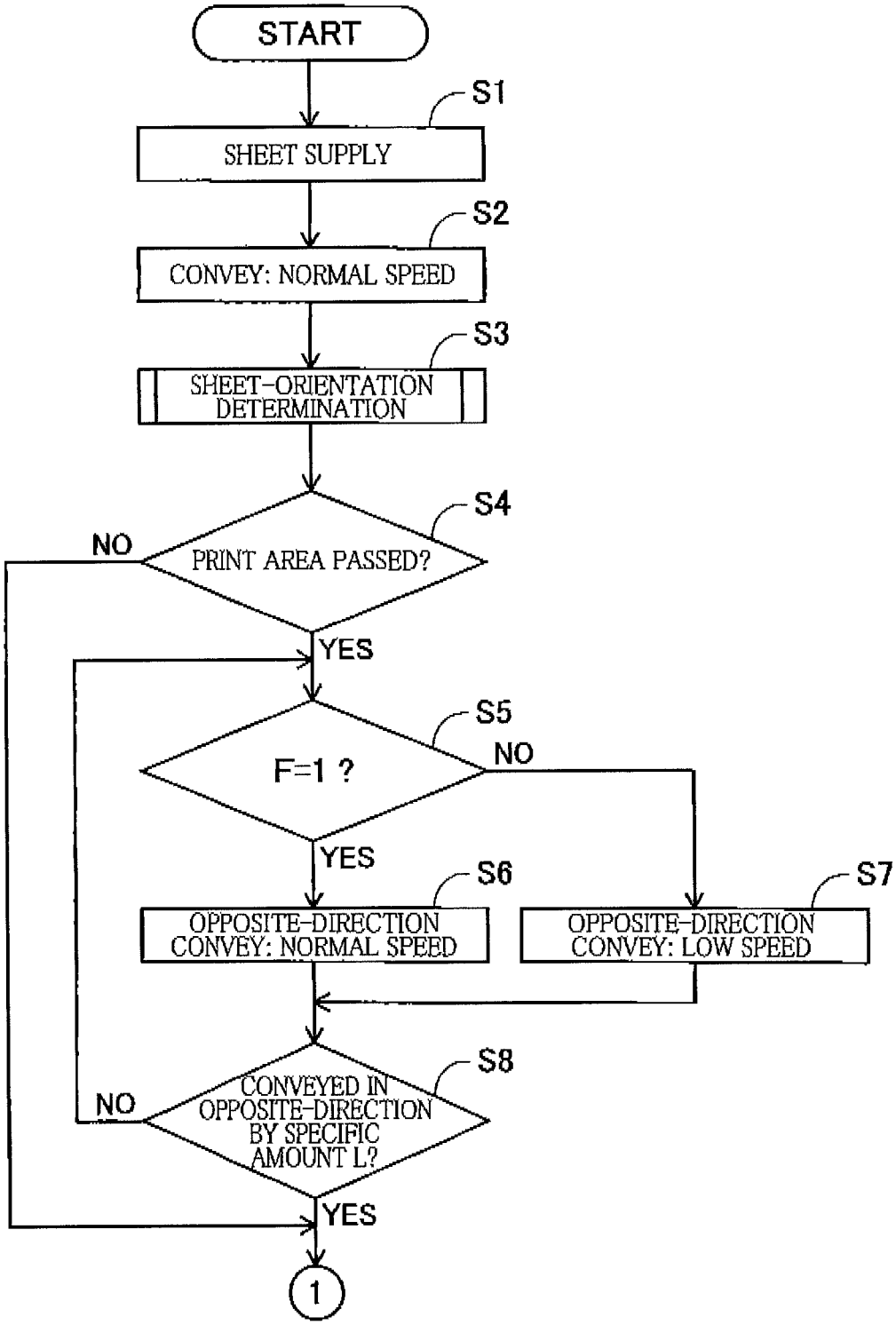
FIG. 3 is a flow chart showing a first half of a print control program depending on an orientation of an envelope.
Figure 4:
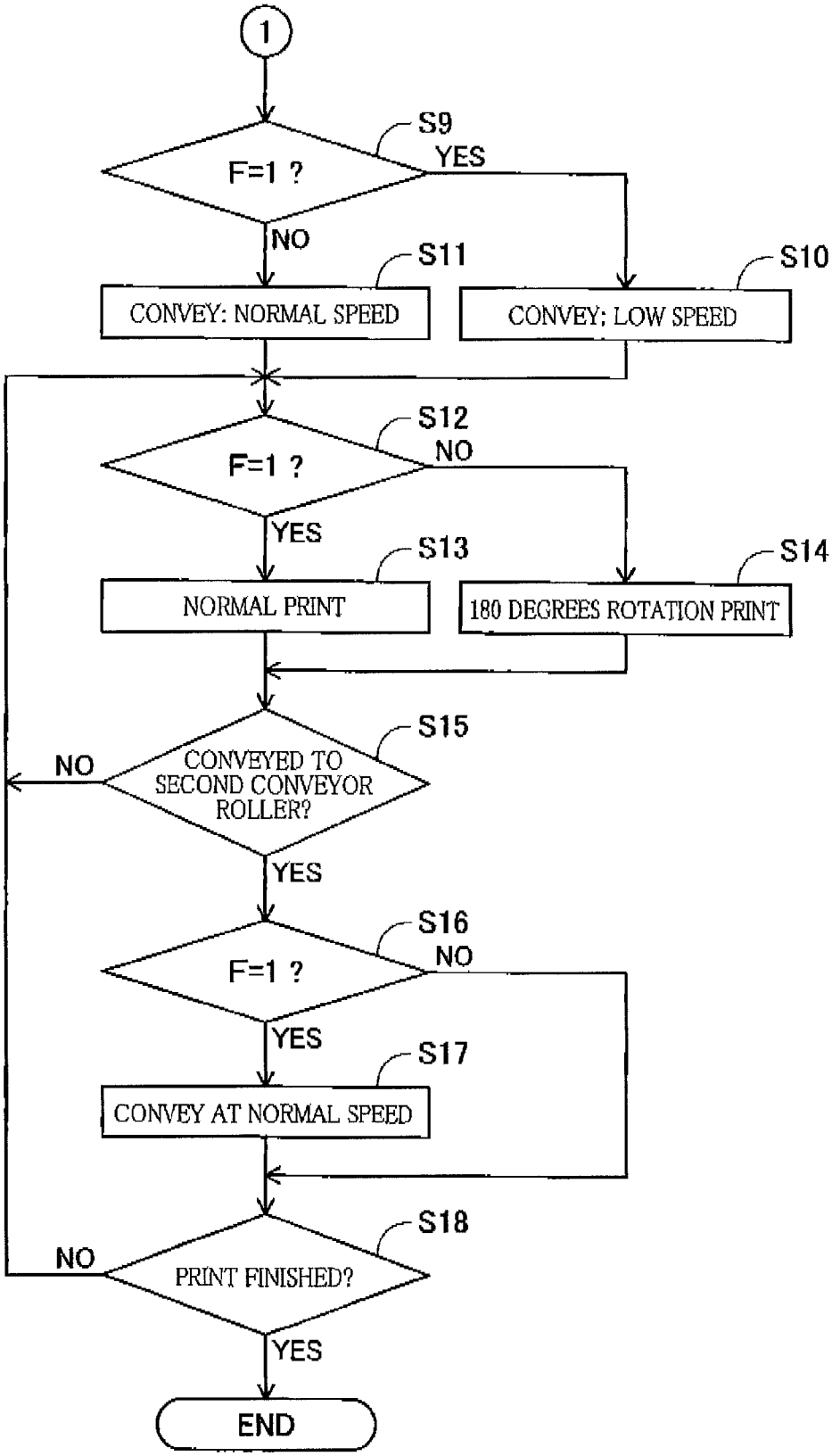
FIG. 4 is flow chart showing a latter half of the print control program depending on the orientation of the envelope.
Figure 5:
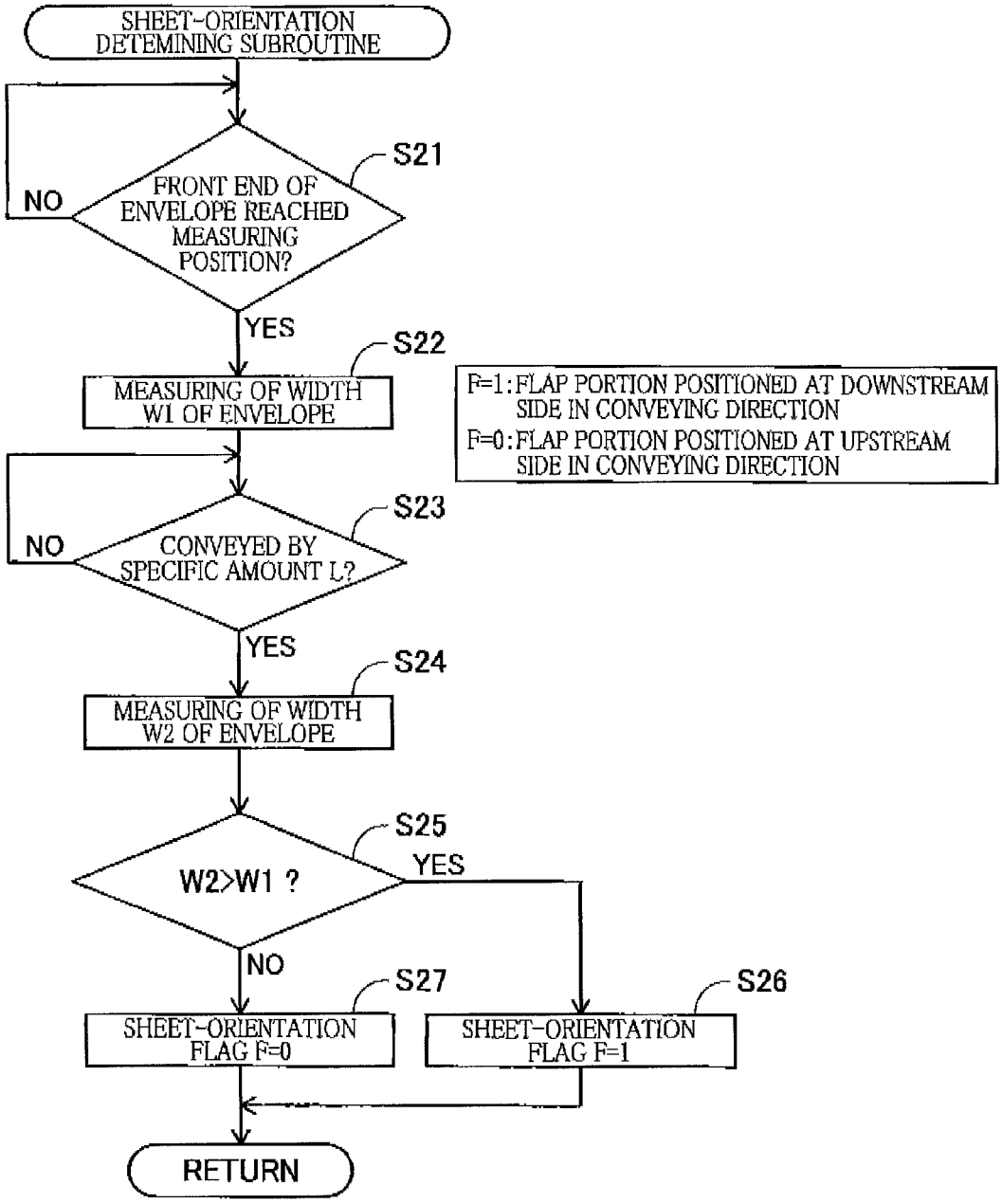
FIG. 5 is a flow chart showing a sheet-orientation determining subroutine implemented in the print control program shown in FIG. 3.

The above-described printing control depending on the orientation of the envelope is performed by implementing in the CPU 92 of a control program shown in flow charts of FIGS. 3 through 5. Hereinafter, the printing control depending on the orientation of the envelope will be described in detail with reference to the flow charts of FIGS. 3 through 5.

In the control program, when an instruction of print processing on the envelope is transmitted to the controller 90, the envelope accommodated in the sheet-supply tray 30 is supplied to the conveying path 40 by the sheet supplier 32 (step 1: hereinafter "step" is omitted and referred to as "S", S1). Then, the supplied envelope is, by control of the CPU 92, conveyed at a normal speed, i.e., the preset speed described before (S2).

In S3, a sheet-orientation determining subroutine shown in FIG. 5 is executed. In this subroutine, the CPU 92 determines (judges) whether the envelope has been conveyed at a measuring position where a width of the downstream end portion of the envelope in the conveying direction can be measured (S21). In other words, based on a signal from the optical sensor 78, the CPU 92 determines whether the envelope exists on the platen 70. Such determination whether the envelope has been conveyed at the measuring position may be made based on a detection value of the rotary encoder 110, i.e., a conveying amount of the envelope by the first conveyor 62.

In a case where it is determined that the envelope has been conveyed at the measuring position where the width of the downstream end portion of the envelope in the conveying direction can be measured (S21: YES), based on signals from the optical sensor 78 and the linear encoder 112, the width W1 of the envelope is measured by the CPU 92 (S22). Then, the CPU 92 determines whether the envelope has been conveyed by the specific amount L from the measuring position where the width W1 of the envelope is measured (S23). The detection value of the rotary encoder 110 is used for this determination.

In a case where it is determined that the envelope has been conveyed by the specific amount L (S23: YES), based on the signals from the optical sensor 78 and the linear encoder 112, the width W2 of the envelope is measured by the CPU 92 (S24). In a case where the width W1 is smaller than the width W2 (S25: YES), the CPU 92 sets a flag value of a sheet-orientation flag F at 1 (S26). The sheet-orientation flag F is a flag indicating the orientation of the envelope. In a case where the flag value of the flag F is 1, it indicates that the envelope is conveyed in the state in which the downstream end portion of the envelope in the conveying direction is the flap portion. In a case where the flag value of the flag F is 0, it indicates that the envelope is conveyed in the state in which the upstream end portion of the envelope in the conveying direction is the flap portion.

On the other hand, in a case where the width W1 is not smaller than the width W2 (S25: NO), the CPU 92 sets the flag value of the sheet-orientation flag F at 0 (S27). After the flag value of the sheet-orientation flag F is determined, the subroutine is ended and execution is returned to a main routine.

In 54 of the main routine, the CPU 92 determines whether the printing area of the envelope has passed the printable area that can be printed by the recording head 72. More specifically, in the case where the envelope has been conveyed by the specific amount L, the CPU 92 determines whether print data that should be printed on an area of the envelope corresponding to the specific amount L exist. The area of the envelope corresponding to the specific amount L is an area where the length from the downstream end portion of the envelope in the conveying direction is smaller than the specific amount L. In a case where the flag value of the flag F is set at 0 in S27 and in a case where a lower portion of the print data exists in the area of the envelope corresponding to the specific amount L, an affirmative determination is made. On the other hand, in a case where the flag value of the flag F is set at 1 in S26 and in a case where an upper portion of the print data exists in the area of the envelope, an affirmative determination is made. In a case where the printing area of the envelope has passed the printable area by the recording head 72 (84: YES), the CPU 92 determines whether the flag value of the sheet-orientation flag F is 1 (S5). In a case where it is determined that the flag value of the sheet-orientation flag F is set at 1 (S5: YES), by the control of the CPU 92, the envelope is conveyed in the opposite conveying direction to the upstream side in the conveying direction by the first conveyor 64 and the second conveyor 80 at the normal speed, i.e., the same speed as the preset speed described before (S6). On the other hand, in a case where it is determined that the flag value of the sheet-orientation flag F is 0 (S5: NO), by the control of the CPU 92, the envelope is conveyed in the opposite conveying direction to the upstream side in the conveying direction by the first conveyor 64 and the second conveyor 80 at the speed slower than the normal speed (S7). The conveying speed in S7 is determined depending on the width W2 of the envelope measured in S24. This conveying speed in S7 is a predetermined speed depending on the width W2 of the envelope and is made slower as the width W2 increases. Because the envelope is conveyed in the opposite conveying direction at the speed slower than the normal speed, even in a case where the flap portion has passed the first conveyor 64 and is nipped only by the second conveyor 80, such possibility is reduced that, while the envelope is conveyed in the opposite conveying direction, the flap portion is separated (distanced) from the platen 70 and is not appropriately nipped by the first conveyor 64. In a case where the envelope is nipped by both of the first conveyor 64 and the second conveyor 80, the envelope may be conveyed in the opposite conveying direction by those conveyors 64, 80. In a case where the envelope is nipped by one of the first conveyor 64 and the second conveyor 80, the envelope may be conveyed in the opposite conveying direction only by the one of the first, second conveyors 64, 80. Further, even in a case where the envelope is nipped by both of the first conveyor 64 and the second conveyor 80, the envelope may be conveyed in the opposite conveying direction only by driving of the first conveyor 64.

Then, the CPU 92 determines whether the envelope has been conveyed in the opposite conveying direction by the specific amount L (S8). A detection value of the rotary encoder 111 is used for this determination. In a case where it is determined that the envelope has not been conveyed in the opposite conveying direction by the specific amount L (S8: NO), processing of S5 through S8 is repeatedly implemented.

On the other hand, in a case where it is determined that the envelope has been conveyed, in the opposite conveying direction by the specific amount L (S8: YES), or in a case where it is determined that the printing area of the envelope has not passed the printable area by the recording head 72 (S4: NO), the CPU 92 determines whether the flag value of the sheet-orientation flag F is 1 (S9). In a case where it is determined that the flag value of the sheet-orientation flag F is 1 (S9: YES), by the control of the CPU 92, the envelope is conveyed by the first conveyor 64 to the downstream side in the conveying direction at the speed slower than the normal speed (S10). The conveying speed in S10 is determined depending on the width W2 of the envelope measured in S24. On the other hand, in a case where it is determined that the flag value of the sheet-orientation flag F is 0 (S9: NO), by the control of the CPU 92, the envelope is conveyed by the first conveyor 64 to the downstream side in the conveying direction at the normal speed (S11).

The CPU 92 then determines whether the flag value of the sheet-orientation flag F is 1 (S12). In a case where it is determined that the flag value of the flag P is 1 (S12: YES), an operation of the recording portion 36 is controlled by the CPU 92 such that the upper portion of the print data is printed on the downstream end portion of the envelope in the conveying direction (S13). In other words, an address is printed on the envelope in an order from the upper portion of the print data to the lower portion thereof. On the other hand, in a case where it is determined that the flag value of the sheet-orientation flag F is 0 (S12: NO), the operation of the recording portion 36 is controlled by the CPU 92 such that the lower portion of the print data is printed on the downstream end portion of the envelope in the conveying direction (S14). In other words, the print data are turned 180 degrees around, and an address is printed on the envelope in an order from the lower portion of the print data to the upper portion thereof.

Thereafter, the CPU 92 determines whether the envelope has been conveyed to the second conveyor 80 (S15). In this determination, in a case where the envelope has been conveyed by a predetermined amount, an affirmative determination is made. In a case where it is determined that the envelope has been conveyed to the second conveyor 80 (S15: YES), the CPU 92 determines whether the flag value of the sheet-orientation flag F is 1 (S16). In a case where it is determined that the flag value of the sheet-orientation flag F is 1 (S16: YES), by the control of the CPU 92, conveying of the envelope at the slower speed by the first conveyor 64 and the second conveyor 80 is ended and the envelope is conveyed at the normal speed (S17). In a case where it is determined that the envelope has not been conveyed to the second conveyor 80 (S15: NO), processing of S12 through S15 is repeatedly implemented.

In a case where conveying of the envelope at the normal speed starts (S17), or in a case where it is determined that the flag value of the sheet-orientation flag F is 0 (S16: NO), the CPU 92 determines whether the printing on the envelope is finished (S18). In a case where it is determined that the printing on the envelope is finished (S18: YES), one execution of the program is ended. In a case where it is determined that the printing on the envelope is not finished (S18: NO), the CPU 92 repeatedly implements processing of S12 through S18.

[Functional Structure of Controller 90]

The CPU 92 of the controller 90 executing the above control program is considered to have a functional structure shown in FIG. 2 in view of its execution processing. As shown in FIG. 2, the CPU 92 includes an orientation detector 120, a measuring portion 122, an opposite-direction conveyor 124 and a conveying-speed changing portion 126.

The orientation detector 120 is a functional portion executing processing of S21 through S27 of the control program, i.e., a functional portion detecting the orientation of the conveyed envelope. The measuring portion 122 is a functional portion executing processing of S22 and S24 of the control program, i.e., a functional portion measuring the width of the envelope. The opposite-direction conveyor 124 is a functional portion executing processing of S4 through S8 of the control, program, i.e., a functional portion conveying in the opposite conveying direction in the case where the printing area of the envelope passes the printable area by the recording head 72. The conveying-speed changing portion is a functional portion executing processing of S5 through S7 and S9 through S11 of the control program, i.e., a functional portion changing the conveying speed depending on the orientation of the envelope.

In the MFP 10, the conveying speed of the envelope can be changed depending on the orientation of the envelope while the envelope is conveyed. Accordingly, for example, in a case where the envelope is conveyed in such a posture that it is considered that a probability of occurrence of jamming is high, the conveying speed of the envelope is made slower than the normal speed. Therefore, even if the envelope is set in any orientation, an image can be recorded on the envelope without jamming.

[Modified Embodiment]

In the illustrated embodiment, the conveying speed of the envelope is changed depending whether the flap portion of the envelope is positioned at the upstream end portion in the conveying direction while conveying. The illustrated embodiment can be considered that, regarding the recording sheet such as a regular paper, the conveying speed is changed depending on an orientation of the recording sheet with respect to the conveying direction while the recording sheet is conveyed (the orientation of the envelope in which the flap portion is positioned at the upstream end portion in the conveying direction and the orientation of the envelope in which the flap portion is positioned at the downstream end portion in the conveying direction). As a modified embodiment, for example, the conveying speed may be changed depending whether the recording sheet is placed and conveyed in such an orientation that the conveying direction is identical with a direction of paper fiber forming the recording sheet while the recording sheet is conveyed. More specifically, in a case where the recording sheet is a sheet of A4 size, in a case where a long side of the A4-size recording sheet is parallel to the direction of paper fiber, the recording sheet is placed such that the conveying direction is parallel to the long side of the recording sheet while the recording sheet is conveyed, and the recording sheet is conveyed such that the conveying direction is parallel to the long side of the recording sheet. In this case where the recording sheet is placed and conveyed in such an orientation that the conveying direction is identical with the direction of paper fiber, the recording sheet is conveyed such that the conveying direction coincides with the direction of paper fiber. In this case, the recording sheet is hardly caught in the conveying path 40. Therefore, in the case where the recording sheet is placed and conveyed in such an orientation that the conveying direction is identical with the direction of paper fiber while the recording sheet is conveyed, the recording sheet is conveyed at the normal speed. The orientation of the recording sheet in the case where the conveying direction is identical with the direction of paper fiber is an example of a predetermined orientation in the present invention.

On the other hand, in a case where the recording sheet is placed and conveyed in such an orientation that the conveying direction is different from the direction of paper fiber during conveying, the recording sheet is conveyed such that the conveying direction is different from the direction of paper fiber while the recording sheet is conveyed. More specifically, in the case where the long side of the A4-size recording sheet is parallel to the direction of fiber as mentioned before, the recording sheet is placed and conveyed such that the conveying direction is parallel to a short side of the A4-size recording sheet while the recording sheet is conveyed. In this case, the recording sheet is easily caught in the conveying path 40. Therefore, in the case where the recording sheet is placed and conveyed in such an orientation that the conveying direction is different from the direction of paper fiber while the recording sheet is conveyed, the recording sheet is conveyed at a speed slower than the normal speed. Accordingly, occurrence of jamming in the recording sheet such as a regular paper can be restrained.

Figure 6:
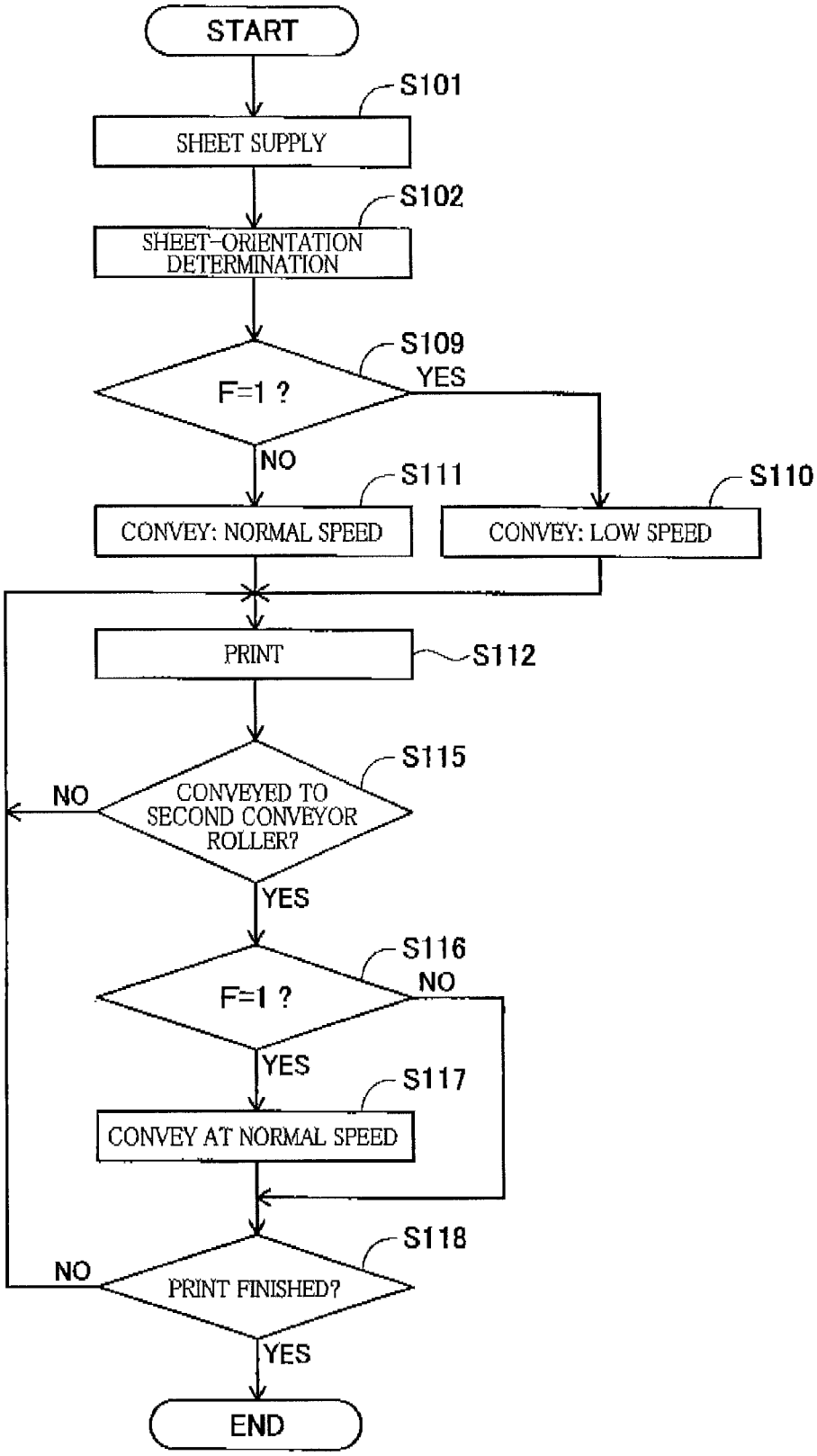
FIG. 6 is a flow chart showing an image-recording control program depending on a direction of paper fiber of a recording sheet.

An image-recording control depending on the direction of paper fiber of the recording sheet is performed by executing by the CPU 92 of a control program shown in a flow chart of FIG. 6. Hereinafter, the image-recording control depending on the direction of paper fiber of the recording sheet will be described with reference to the flow chart of FIG. 6. Description of the same processing as the print control depending on the orientation of the envelope shown in FIGS. 3 through 5 will be omitted.

In FIG. 6, processing of S101 is the same as that of S1 in FIG. 3. Then, the CPU 92 determines whether the conveying direction is identical with the direction of paper fiber of the recording sheet while the recording sheet is conveyed (S102). In a printer portion in the modified embodiment, there is disposed a switch (not shown) set by a user, and the user sets the switch to "ON" in a case where the recording sheet is placed and conveyed in such an orientation that the conveying direction coincides with the direction of paper fiber of the recording sheet while the recording sheet is conveyed. In other words, in a case where the recording sheet is accommodated in the sheet-supply tray 30 such that the recording sheet can be conveyed in a state in which the direction of paper fiber of the recording sheet while the recording sheet is conveyed coincides with the conveying direction, the user sets the switch to "ON". For example, in the case where the long side of the A4-size recording sheet is parallel to the direction of paper fiber, the user sets the switch to "ON" in a case where the recording sheet is placed in the sheet-supply tray 30 such that the conveying direction is parallel to the long side of the A4-size recording sheet while the recording sheet is conveyed. Further, the user sets the switch to "OFF" in a case where the recording sheet is placed in the sheet-supply tray 30 such that the conveying direction is parallel to the short side of the A4-size recording sheet while the recording sheet is conveyed. That is, the user sets the switch according to whether the recording sheet is placed such that the conveying direction is parallel to the long side of the A4-size recording sheet or the conveying direction is parallel to the short side of the A4-size recording sheet. Further, in place of the switch, the user may set the orientation of the recording sheet while, the recording sheet is conveyed by an user settings (the recording sheet is placed in the sheet-supply tray 30 such that the long side of the recording sheet is parallel to the conveying direction or perpendicular to the conveying direction). Accordingly, the CPU 92 determines that, in a case where the switch is set to "ON", the conveying direction is identical with the direction of paper fiber while the recording sheet is conveyed, and, in a case where the switch is set to "OFF", the conveying direction is different from the direction of paper fiber while the recording sheet is conveyed. In a case where it is determined that the switch is set to "ON", the flag value of the sheet-orientation flag F is set at 0, and, in a case where it is determined that the switch is set to "OFF", the flag value is set at 1.

Processing of S109 through S111 is the same as that of S9 through S11 in FIG. 4. When the recording sheet is conveyed to the recording portion 36, the operation of the recording portion 36 is controlled by the CPU 92 such that an upper portion of print data is recorded on a downstream end portion of the recording sheet in the conveying direction (S112). In other words, an image is recorded on the recording sheet in an order from the upper portion of the print data to the lower portion thereof. Processing of S115 through S118 is the same as that of S15 through S18, and, in S118, M a case where it is determined that the image recording on the recording sheet is finished, one execution of the program is ended.

In the modified embodiment, a functional portion executing processing of S102 of the control program corresponds to the orientation detector 120, and a functional portion executing processing of S109 through S111 of the control program corresponds to the conveying-speed changing portion 126.

The present invention is not limited to the illustrated embodiments. It is to be understood that the present invention may be embodied with various changes and modifications that may occur to a person skilled in the art, without departing from the spirit and scope of the invention defined in the appended claims. More specifically, for example, when printing is performed on a plurality of envelopes, in a case where it is determined regarding a first one of the plurality of envelopes that the flap portion is positioned at the downstream end portion of the envelope in the conveying direction, a second one and the rest of the plurality of envelops may be conveyed at the conveying speed changed to be slower than the preset speed. In this case, even in the conveying path 40 before the orientation of the envelope is detected by the optical sensor 78 and so on, occurrence of jamming can be restrained.

Though, in the illustrated embodiment and the modified embodiment, it is described that the CPU 92 executes the processing shown in FIGS. 3 through 6, instead of the CPU 92, those processing may be executed by the ASIC 102 and other logic integrated circuits and may be executed in cooperation with the CPU 92, the ASIC, and the other logic integrated circuits. Further, those processing may be executed by software such as program stored in the ROM 94 and may be executed in cooperation with the software, the CPU 92, the ASIC 102 and the other logic integrated circuits.

Moreover, though, in the illustrated embodiment, the widths W1 and W2 of the envelope are detected by the optical sensor 78 and the linear encoder 112 disposed at the carriage 74, instead of the optical sensor 78 and the linear encoder 112, a sensor for detecting a width of the envelope may be disposed on an upstream side of the first conveyor 64 in the conveying direction. Based on the width detected by the sensor, the orientation of the envelope may be determined. Further, as mentioned before, the orientation of the envelope may be determined by operation of the switch by the user and so on. In this case, detection of the widths W1, W2 based on the optical sensor 78 is unnecessary, so that the conveying speed is determined according to the operation of the switch by the user. In those cases, processing of S4 through S8 in FIG. 3 is omitted.

Furthermore, though, in the illustrated embodiment, positions of the opposite ends of the recording sheet in the direction perpendicular to the conveying direction are detected by the optical sensor 78 and the linear encoder 112, and the width of the recording sheet is measured based on the distance between the opposite ends of the recording sheet, a position of one of the opposite ends of the recording sheet in the direction perpendicular to the conveying direction may be detected and the width of the recording sheet may be measured based on the position of one of the opposite ends of the recording sheet. In a case where the recording sheet is conveyed in a state in which a center (a middle) of the recording sheet in the direction perpendicular to the conveying direction generally coincides with a center of the conveying path 40 in the direction perpendicular to the conveying direction, the width of the recording sheet can be measured by detecting the position of one of the opposite ends of the recording sheet. Therefore, the width of the recording sheet can be measured in a short time.

In the illustrated embodiment, in S6, such an example is explained that the envelope is conveyed in the opposite conveying direction at the same speed as the preset speed described before, but the present invention is not limited to this. The conveying speed in the opposite conveying direction in S6 may be faster or slower than the preset speed. In this case, it is preferable that the conveying speed in the opposite conveying direction in S7 is slower than the above-mentioned speed. This case can restrain, the occurrence of jamming.

What is claimed is:

1. An image recording apparatus comprising:

a sheet supplier configured to supply a recording medium;

a first conveyor configured to convey the recording medium supplied from the sheet supplier in a conveying direction;

a recording portion configured to record an image on the recording medium conveyed by the first conveyor; and a controller configured to:

detect an orientation of the recording medium with respect to the conveying direction while the recording medium is conveyed, wherein the recording medium comprises an envelope; and when the detected orientation of the recording medium with respect to the conveying direction is determined to be different from a predetermined orientation, make the conveying speed of the recording medium by the first conveyor a first speed which is lower than a second speed of conveying the recording medium by the first conveyor when the detected orientation of the recording medium with respect to the conveying direction is the same as the predetermined orientation, wherein the predetermined orientation includes a flap portion of the envelope corresponding to an upstream end portion of the envelope in the conveying direction.

2. The image recording apparatus according to claim 1, further comprising a detector configured to detect at least one end portion of a plurality of end portions of the envelope in a direction perpendicular to the conveying direction, wherein the controller is further configured to measure at least one length of the envelope in the direction perpendicular to the conveying direction based on a position of the at least one end portion of the envelope detected by the detector and to detect the orientation of the envelope during conveying based on:

(1) a first measured value which is a length of the envelope in the direction perpendicular to the conveying direction at a downstream end portion of the envelope in the conveying direction, and (2) a second measured value which is a length of the envelope in the direction perpendicular to the conveying direction at a position distanced, by a specified amount to an upstream side in the conveying direction, from a position of the envelope when the first measured value is measured.

3. The image recording apparatus according to claim 2, wherein the controller is configured to detect that the orientation of the envelope with respect to the conveying direction is different from the predetermined orientation, when the first measured value is determined to be smaller than the second measured value.

4. The image recording apparatus according to claim 1, further comprising a second conveyor located on a downstream side of the recording portion in the conveying direction and configured to convey the recording medium, wherein the controller is configured to convey, when a part of the recording medium on which an image is recorded has passed a recordable image area of the recording portion, the recording medium by at least one of the first conveyor and the second conveyor in an opposite conveying direction opposite to the conveying direction.

5. The image recording apparatus according to claim 4, wherein the controller is configured to make, when the orientation of the recording medium with respect to the opposite conveying direction is different from the predetermined orientation, the conveying speed of the recording medium by the second conveyor a first speed which is lower than a second speed of conveying the recording medium by the second conveyor when the orientation of the recording medium with respect to the opposite conveying direction is the same as the predetermined orientation.

6. The image recording apparatus according to claim 1, further comprising a second conveyor located on a downstream side of the recording portion in the conveying direction and configured to convey the recording medium, wherein the controller is configured to keep, in a case where the conveying speed of the recording medium by the first conveyor is set to the first speed in a case where the orientation of the recording medium with respect to the conveying direction is different from the predetermined orientation, the conveying speed of the recording medium by the first conveyor at the first speed until the recording medium is conveyed to the second conveyor.

7. The image recording apparatus according to claim 1, wherein the controller is configured to reduce, in a case where the conveying speed of the recording medium is set to the first speed in a case where the orientation of the recording medium with respect to the conveying direction is different from the predetermined orientation, the conveying speed of the recording medium as a length of the recording medium in a direction perpendicular to the conveying direction increases.

* * * * *